US006128943A

United States Patent [19]

Lemmens

[11] Patent Number: 6,128,943

[45] Date of Patent: Oct. 10, 2000

[54] ADJUSTMENT MECHANISM FOR HAND TOOLS

[76] Inventor: Joseph R. Lemmens, 910 S. Salem St., Apex, N.C. 27502

[21] Appl. No.: 09/314,502

[22] Filed: May 19, 1999

Related U.S. Application Data

[60] Provisional application No. 60/086,310, May 21, 1998.

[51] Int. Cl.[7] ..... B21D 7/06

[52] U.S. Cl. ..... 72/409.01; 81/416; 81/385; 81/387; 30/192

[58] Field of Search ..... 72/409.01, 409.12, 72/409.1; 81/416, 385, 393, 386, 387; 30/192, 191, 259

[56] References Cited

U.S. PATENT DOCUMENTS

| | | | |
|---|---|---|---|
| 584,191 | 6/1897 | Porter | 81/387 |
| 2,926,556 | 3/1960 | Dupre | 72/409.12 |
| 5,012,666 | 5/1991 | Chen | 81/382 |
| 5,842,371 | 12/1998 | Liaw | 72/409.12 |

FOREIGN PATENT DOCUMENTS

| | | | |
|---|---|---|---|
| 1150500 | 8/1957 | France | 81/385 |
| 916411 | 1/1963 | United Kingdom | 81/416 |

*Primary Examiner*—Daniel C. Crane

[57] ABSTRACT

The present invention is an adjustment mechanism for both hand and production tools of any capacity. An eccentric pin mechanism provides the pivot between two handles or other load transferring members. The rotation of the pin moves the two members closer or farther apart, indirectly controlling the final position of the blades or jaws. This adjustment can be used to compensate for wear or to provide adjustment for a specific use. The eccentric pin is locked into position by means of a pressure pin mechanism. For light duty tools, this pressure pin mechanism would consist of a spring loaded pin which resists rotation of the eccentric pin during normal operation of the tool. The spring loaded pin would allow rotation of the eccentric pin when a tool is used to rotate it. For heavy duty applications, the pressure pin mechanism would consist of a solid set screw. This set screw would be loosened before rotation of the eccentric pin, and then tightened after adjustment to prevent rotation of the pin during normal use. Rotation of the eccentric pin can be performed with various hand tools. A handwheel or lever could be used for certain applications which would require rapid adjustment of the tool. This handwheel or lever would allow adjustment of the eccentric pin without the use of tools. In this situation, a second eccentric pin could be located at another pivot point to provide additional adjustment.

19 Claims, 6 Drawing Sheets

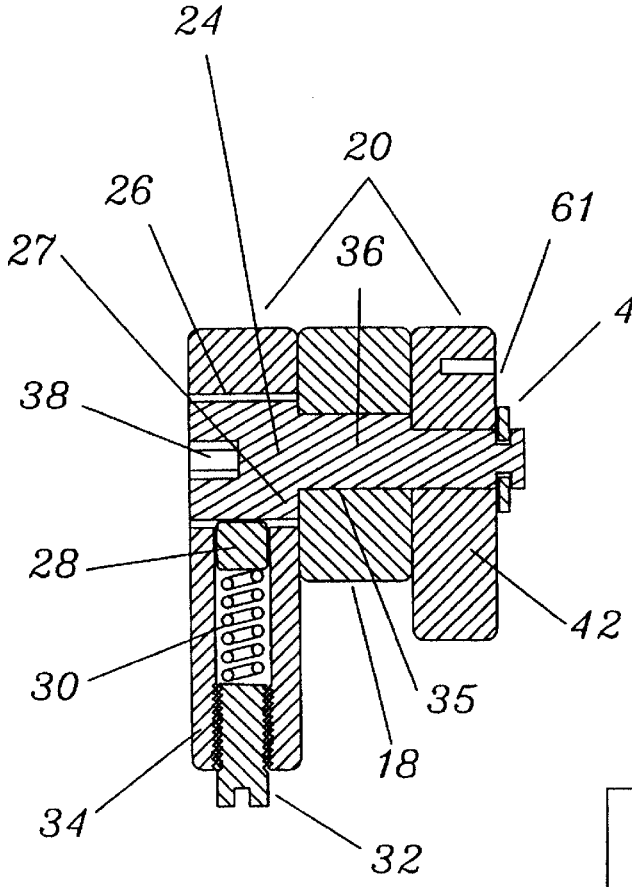
1b
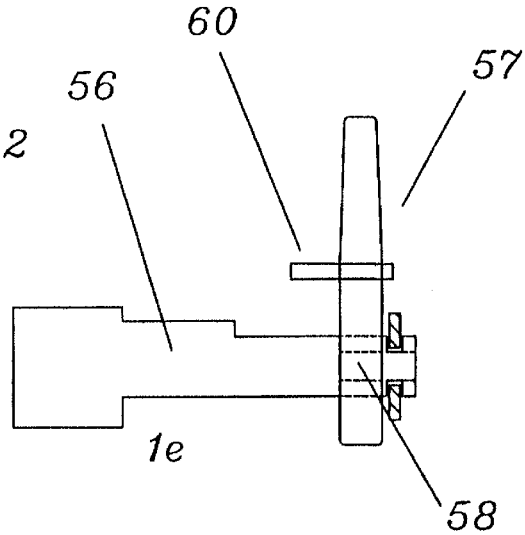
1e
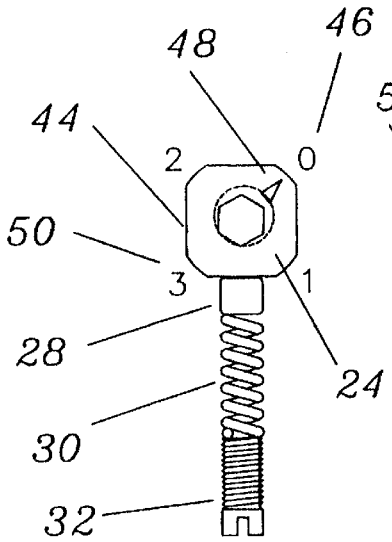
1c
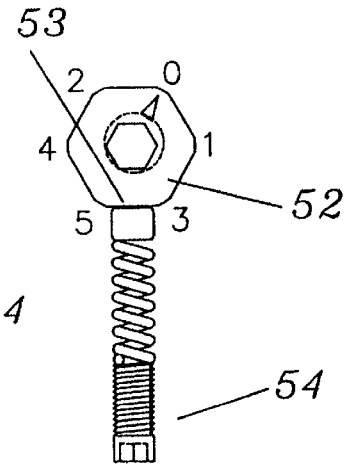
1d

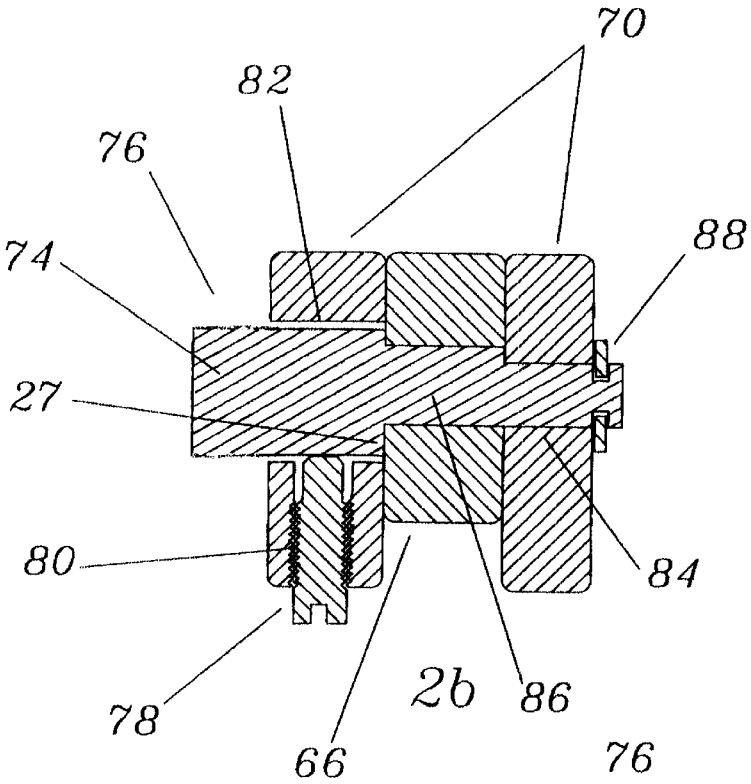
2b
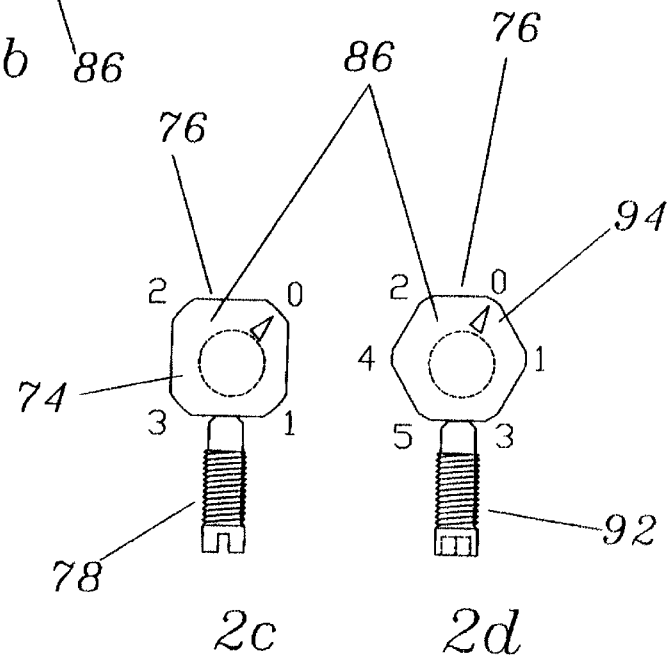
2c 2d

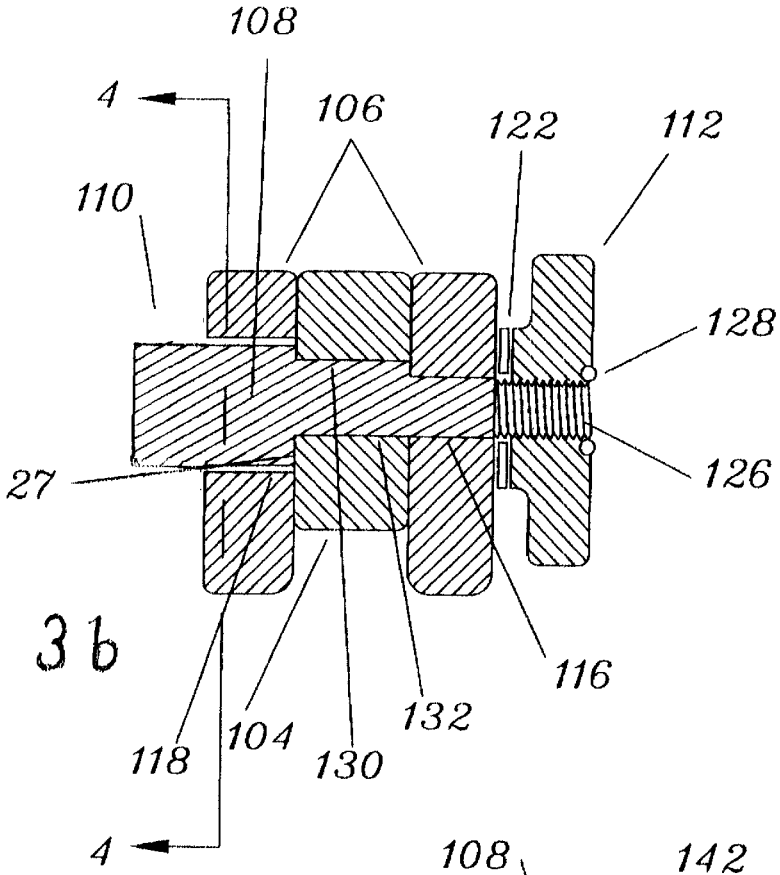
3b
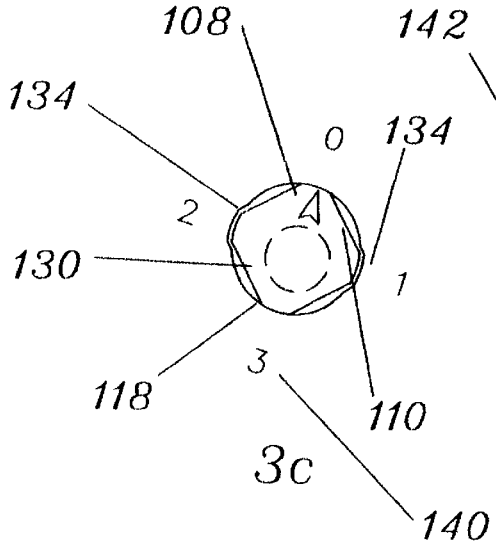
3c
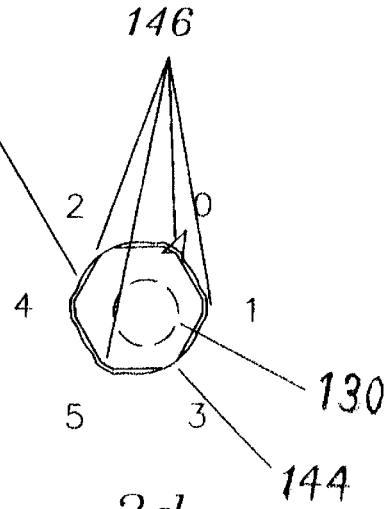
3d

ADJUSTMENT MECHANISM FOR HAND TOOLS

This application claims benefit of provisional application Ser. No. 60/086,310 filed May 21, 1998.

FIELD OF THE INVENTION

The present invention relates to the design and construction of adjustment mechanisms commonly employed in hand tools which create compressive forces between their blades or jaws. This includes crimping tools, swaging tools, and bolt cutters. Mechanisms which adjust the position of the blades or jaws have been used with medium and heavy duty hand tools for many decades. These mechanisms allow the operator to adjust the final positioning of the jaws and thereby control parameters such as peak force and crimp size.

A second function of the adjustment mechanism is the compensation for wear occurring in the components of the tool. As the blades, jaws, or pivot pins wear, it is necessary to adjust for this wear. Without adjustment, the worn tool would either fail to close properly and the tool's performance would suffer.

Adjusting mechanisms also permit the use of multiple strokes with the tool. For example, after an initial crimping, the operator could rotate the eccentric pin and perform a second crimping to crimp even more.

DESCRIPTION OF THE PRIOR ART

The present invention is concerned with medium and heavy duty tools. These types of tools generally include a compound lever system that creates a maximum force at or near full closure of the blades or jaws.

Light duty hand tools do not need much adjustment because they do not use a compound lever system. Compound lever systems do not work properly when components are worn because it is necessary to create a maximum force at or near full closure. It has therefore been a common feature of medium and heavy duty hand tools, such as bolts cutters and swagging tools, to incorporate adjustment mechanisms into the tool.

Many previous adjustment mechanisms have been designed for medium and light duty applications and are not suitable for heavy duty tools such as U.S. Pat. No. 3,733,626 by Irvin Allen and U.S. Pat. No. 5,012,666 by Ching Wen Chem.

U.S. Pat. No. 5,063,770 by Ching Wen Chem and U.S. Pat. No. 5,067,370 by Joseph Lemmens are examples of mechanisms which are not quickly adjustable. These mechanisms require multiple steps to adjust.

Other current designs have complex, multi-part adjustment mechanisms which require elaborate operations to adjust. These mechanism use an adjustable bar held to the handle by a pivot pin and a locking bolt. In addition, two hex head screws are used to adjust the bar, indirectly adjusting the position of the blade of the tool at full closure position. This system is both extremely complex and difficult to adjust because of the small size of the hex head screws. These screws adjust the blade position in a nonlinear manner and often corrode and break under normal use.

U.S. Pat. No. 5,012,666 by Chen et al. describes a system which adjusts the distance between two of the pivot points on the tool. This system involves many moving parts which are under high stresses. The adjustment system is also easy to adjust accidentally during normal use.

None of these designs and mechanisms allow the operator to precisely and quickly adjust the position of the jaw in heavy duty hand tools. Therefore there is a need for a simple, reliable and low cost adjusting mechanism with precise adjustments, incremental wear compensation and good reliability.

OBJECTS AND ADVANTAGES

The primary object and advantage of the present invention is to provide an adjustable control mechanism for hand tools and table production tools which provides the operator with the capability to easily adjust the final blade or jaw position. This allows the operator to quickly adjust the tool when the tool components have worn and the tool cannot operate optimally.

A second object of the invention is to permit the use multiple strokes with the tool. For example, after an initial crimping, the user could rotate the eccentric pin and perform a second crimping to crimp even more.

Another advantage of the invention is the ease in which the system can be adjusted. The pressure pin mechanism resists the motion of the eccentric pin during normal use. When enough force is applied to the eccentric pin, the pressure pin will allow it to rotate. The entire operation can be performed with a partial turn of a wrench. The use of a control lever or handwheel on the eccentric pin would allow even faster adjustment. Current mechanisms in production require wrenches or keys to adjust.

Another advantage of this invention is that it can be easily incorporated into current tool design. The eccentric pin assembly can replace any pivot pin currently on a tool. Components such as handles, blades, jaws, and plates could remain the same.

A further object of the invention is to provide a design which can be manufactured easily. The main components can easily be manufactured using automatic processes such as an automatic lathe for the eccentric pin and injection die casting for the lever and control. This allows the proposed design to be manufactured easily and inexpensively.

BRIEF DESCRIPTION OF THE DRAWINGS

FIG. 1*b* shows a cross-sectional view following line 1—1 of FIG. 1*a* of the adjustment mechanism.

FIG. 1*c* shows an enlarged view of the adjustment mechanism of FIG. 1*a*.

FIG. 1*d* shows an alternative design of FIG. 1*c*.

FIG. 1*e* shows an alternative design of FIG. 1*b* in relation of the eccentric pin.

FIG. 2*b* shows a cross sectional view following line 2—2 of FIG. 2*a* of the adjustment mechanism.

FIG. 2*c* shows an enlarged view of the adjustment mechanism of FIG. 2*a*.

FIG. 2*d* shows an alternative design of FIG. 2*c*.

FIG. 3*b* shows a cross-sectional view following line 3—3 of FIG. 3*a* of the adjustment mechanism.

FIG. 3*c* shows an enlarged view of the adjustment mechanism of FIG. 3*a*.

FIG. 3*d* shows an alternative design of FIG. 3*c*.

Reference Numerals in Drawings

FIG. 1

Figure 1A:
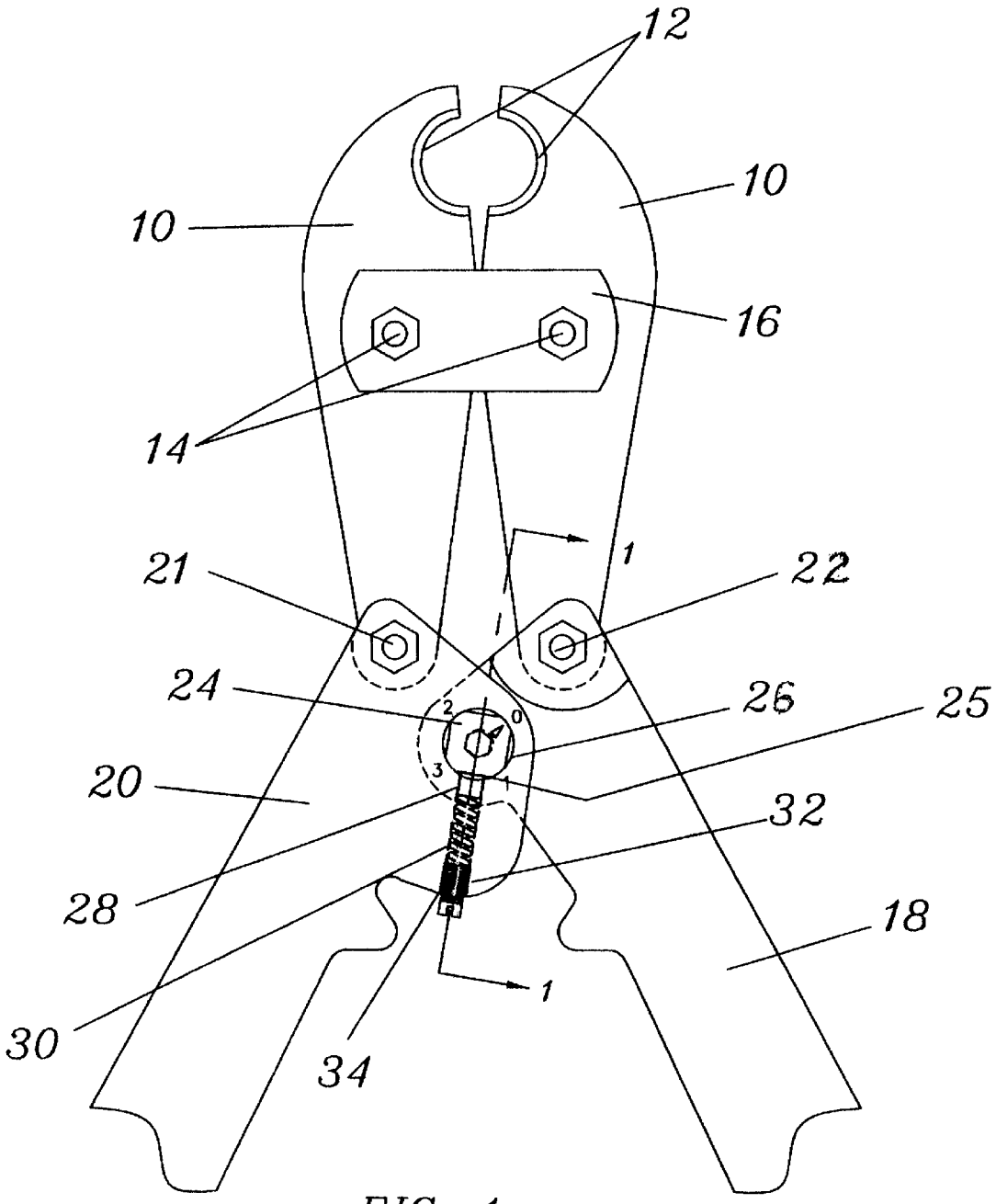
FIG. 1*a* shows a top view of an adjustment mechanism for hand tools in accordance with the first embodiment of the invention (as part of a compression tool).

| | |
|---|---|
| 10 blades | 12 compression surfaces |
| 14 blade bolts | 16 plates |
| 18 handle | 20 handle |
| 21 handle bolt | 22 handle bolt |
| 24 square eccentric pivot pin | 26 large circular hole |
| 27 shoulder head of pivot pin | 28 pressure pin |
| 30 spring | 32 adjusting screw |
| 34 threaded hole | 35 medium hole |
| 36 eccentric segment of pivot pin | 38 Allen surface |
| 40 C-clip | 42 small hole |
| 44 square head flat surface | 46 (0) minimum |
| 48 pointer | 50 (3) maximum |
| 52 hexagonal eccentric pivot pin | 53 hexagonal head flat surface |
| 54 Allen screw | 56 eccentric pivot pin |
| 57 adjusting knob | 58 mating surface |

FIG. 2

| | |
|---|---|
| 60 stopper pin | 61 stopper pin hole |
| 62 cutting surface | 64 blade |
| 66 blade | 68 handle |
| 70 handle | 72 central bolt |
| 74 eccentric pivot pin | 76 rounded corner adjusting head |
| 78 set screw | 80 threaded hole |
| 82 large circular hole | 84 small hole |
| 86 eccentric segment | 88 C-clip |
| 92 Allen screw | 94 hexagonal pivot pin |

FIG. 3

| | |
|---|---|
| 100 compression holes | 102 blade |
| 104 blade | 106 handle |
| 108 eccentric pivot bolt | 110 rounded corner square head |
| 112 knob | 116 small hole |
| 118 large quasi circular hole | 120 shoulder head |
| 122 friction washer | 126 threaded segment |
| 128 nylon lock | 139 eccentric segment |
| 132 medium hole | 134 rounded pockets (2) |
| 136 pointer | 138 (0) minimum |
| 140 (3) maximum | 142 large quasi-circular hole |
| 144 rounded hexagonal pivot bolt | 146 rounded pockets (4) |

SUMMARY OF THE INVENTION

The present adjustment mechanism for hand tools consists of an eccentric pin located at one of the pivot connections on a tool. For instance, the eccentric pin can be placed in between the handles or at the connection of the handle to the tool blades. The eccentric pin controls the relative spacing between two of the tools moving components. This indirectly controls the final positioning of the tool blades or jaws The eccentric pin mechanism can be placed at any pivot on the tool. The strength of the eccentric pin design allows it to be used at pivots carrying even the highest loads. Placing the pin at the highest stressed pivots would allow a small adjustment of the eccentric pin to provide a similar adjustment in the blade or jaw position.

A pressure pin mechanism presses on the eccentric pin head and resists the rotation of the eccentric pin. The pressure pin mechanism can be designed to allow the operator to rotate the eccentric pin with or without the use of tools, while preventing the pin from rotating during normal Periodic adjustment of the tool can be done easily and precisely since each step adjustment of the eccentric pin adjusts the tool a finite amount. The maximum number of adjusting steps can only be realized if the pin is rotated in alternate directions during each adjustment. If the eccentric pin is adjusted in only one direction, only one half of a revolution can be used and fewer adjustments will be realized. For example, a square head pin will allow 2 adjustments, a hexagonal will give 3 adjustments, and an octagonal pin 4 adjustments. Generally these steps adjustment will provide between 0.005 inch and 0.020 inch adjustment of the blades or jaws.

DESCRIPTION—FIGS. 1 TO 3

The first embodiment of the adjustment mechanism of the present invention is shown in FIG. 1A, incorporated in a compression tool. FIG. 1B gives a cross-sectional view of this first embodiment of the adjustment mechanism, along the section lines 1—1 in FIG. 1A. FIG. 1C gives an enlarged front view of the adjustment mechanism. FIG. 1D shows an enlarged front view of an alternative design of the adjustment mechanism. FIG. 1E gives a cross-sectional view of an alternative design of the eccentric pivot pin.

The compression tool shown in FIG. 1A has two blades 10, with compression surfaces 12, secured together by plates 16 and blade bolts 14. The blades 10 are operatively connected to handles 18 and 20 through handle bolts 21 and 22. Handles 18 and 20 are rotationally connected to a square eccentric pivot pin 24. A pressure pin 28 is pushed against a square head flat surface 44 by a spring 30. Spring 30 is compressed by an adjusting screw 32, which is located in a threaded hole 34 of handle 20.

The eccentric pivot pin 24 is the most important part of the adjustment mechanism of the present invention, and is located at one of the pivot points of the tool. The eccentric pivot pin is most readily incorporated in a configuration such as that shown in cross-section in FIG. 1B, where handle 20 has double walls and handle 18 has a central section between these two walls. Such a configuration is customary in most medium and heavy duty tools, but is also presently seen in some light duty tools. As seen in FIG. 1B, the eccentric pivot pin 24 is housed in a large circular hole 26 and a small hole 42 of handle 20; the eccentric segment 36 is located in a medium hole 35 in the central section of handle 18. The size of the small hole 42 is determined by the minimum strength required for the pivot pin. The size of the medium hole 35 is dictated by the amount of adjustment desired over the life of the tool or the number of step adjustments desired. The diameter of the large circular hole 26 is dictated by the size of the pivot pin used for the adjustment mechanism, and must be at least as large as the sum of the small hole diameter plus three times the eccentric variation of the pivot pin. FIG. 1B also shows that the eccentric pivot pin 24 is axially secured by shoulder head 27 and C-clip 40. Adjusting screw 32 holds spring 30 and pressure pin 28 in threaded hole 34. Eccentric pivot pin 24 can be rotated by means of an Allen surface 38.

An enlarged front view of the square eccentric pivot pin 24, as it would appear removed from the mechanism, is given as FIG. 1C, showing details of a pointer 48 and numeral position markers. The pivot pin can be rotationally adjusted from a minimum at the numeral 0 shown as 46, to a maximum at the numeral 3, shown as 50.

FIG. 1D shows an alternative design utilizing a hexagonal eccentric pivot pin 52. In this alternative configuration of the adjustment mechanism, an Allen screw 54 provides a stronger means of adjustment.

FIG. 1E shows a cross-sectional view of an alternative eccentric pivot pin 56. In this configuration, the end of the pivot pin supports an adjusting knob 57 rotationally secured by a mating surface 58 and axially secured by a C-clip as before. A stopper pin 60 limits the motion of the adjusting knob 57. The use of an adjusting knob offers increased ease and speed of adjustment. Knob 57 can be adjusted by 60 degrees if mating surface is a hexagon or 30 degrees if mating surface is a 12 point surface.

Fabrication of eccentric pins 24, 52, and 56 is usually done through machining of a square or hexagonal bar of carbon steel on a production lathe or a CNC machine center, with an extra step for the Allen surface 38 or mating surface 58. The machining would be followed by a hardening and tempering of the material, plus an anti-corrosion treatment. Other components, such as C-clip 40, pressure pin 28, spring 30, adjusting screw 32, adjusting knob 57 and stopper pin 60 are all readily available industrial components. The pressure pin, spring and screw are even available as a single unit in various designs, sizes and strengths.

Assembly of this first embodiment of the adjustment mechanism can be carried out in at least two different ways. In one method, the complete tool can be assembled except for the eccentric pivot pin 24, which can then be inserted through large circular hole 26, medium hole 35, and small hole 42 and secured with C-clip 40. Proper positioning of the blades 10 and the handles 18 and 20 allows easy insertion of eccentric pivot pin 24. The next steps are adjustment of the pointer 48 with an Allen key, and insertion of pressure pin 28, spring 30, and screw 32. In a second method, the two handles 18 and 20 can be assembled with eccentric pivot pin 24 prior to the assembly of the head of the tool.

Tool calibration should be done at one of the handle bolts 21 or 22 through cutting at final size or clearance cutting during final assembly. This will allow the eccentric pin rotation and pointer to be set with a minimum at the numeral 0, and therefore allow the maximum number of adjustment steps.

It may be helpful for fabrication of the eccentric pivot pin to include information needed to determine the offset of the minimum eccentricity, the alignment of the pointer in relation to the pivot pin 24 and the handle bolts 21 and 22, and to calculate the adjustment steps giving best variation of eccentricity between minimum and maximum. The offset discussed here is defined at the fully closed position of the tool, and is measured along a line from the eccentric pivot pin 24 to a handle bolt 22. If an acceptable step variation for a hand tool is approximately 0.010", then the maximum eccentricity would be less than 0.040" for the square adjustment mechanism and less than 0.060" for the hexagonal adjustment mechanism. To provide nearly equal variation for each adjustment step of the eccentric pivot pin it is necessary to locate the minimum eccentricity in an offset position in relation to pivot pin 24 and handle bolt 22. It should be noted that if the minimum eccentricity were located toward bolt 22, the first two adjustment steps would provide the same degree of eccentricity and one or two potential adjustment step would be lost.

Approximately equal variation of eccentricity with each adjustment step for the square eccentric pivot pin will be achieved with a 17.5 degree offset when the 0 position lines up with bolt 22, and with equal steps of 45 degrees. Since eccentricity does not differentiate between positive and negative angles, the recommended steps are: 0=−17.5; 1=62.5; 2=−107.5; 3=152.5. Similarly, to provide the best variation of eccentricity from minimum to maximum with the hexagonal eccentric pivot pin, an offset of 15 degrees is required at the 0 position, and the variation between steps will be 30 degrees. The steps will therefore be: 0=−15; 1=45; 2=−75; 3=105; 4=−135; 5=165.

Figure 2A:
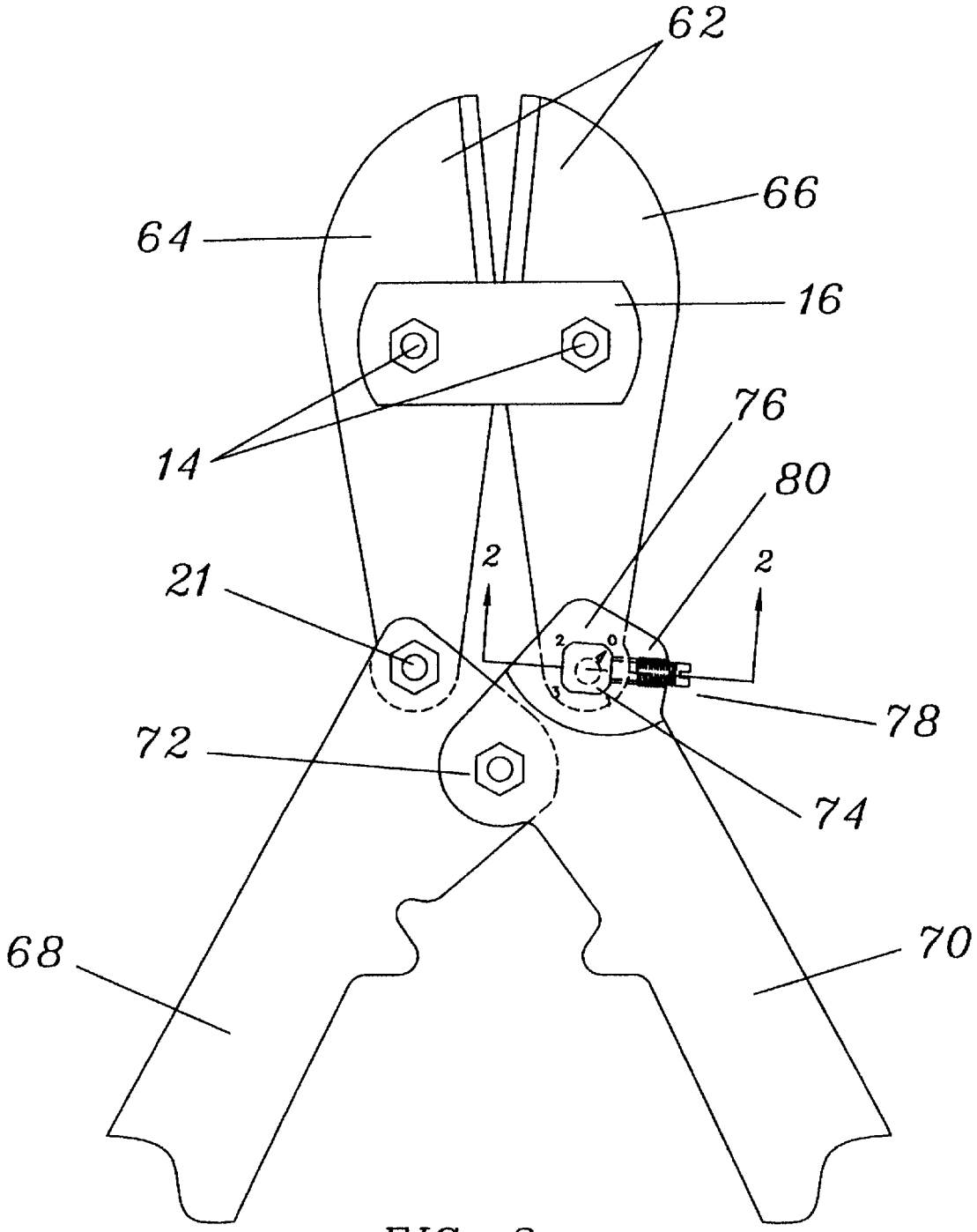
FIG. 2*a* shows a top view of an adjustment mechanism for hand tools in accordance with the second embodiment of the invention (as part of a bolt cutter tool).

A second embodiment of the present invention provides a direct locking of the adjustment mechanism and is thus well-suited to heavy-duty hand tools such as the bolt-cutting tool shown in FIG. 2A. A cross-section of the adjustment mechanism is shown in FIG. 2B, following the section lines 2—2 in FIG. 2A. An enlarged front view of the adjustment mechanism is shown in FIG. 2C, with an alternative design of the eccentric pivot pin presented in FIG. 2D.

The bolt-cutting tool in FIG. 2A has cutting surfaces 62 on blades 64 and 66, which are held together by plates 16 and blade bolts 14. Blade 64 is connected to a handle 68 by a handle bolt 21. The two handles 68 and 70 are connected by a central bolt 72. Blade 66 is connected to a handle 70 by an eccentric pivot pin 74. The eccentricity of pivot pin 74 is set through rotation of an adjusting head 76. A set screw 78 in a threaded hole 80 locks pivot pin 74 in the chosen position.

The mechanism of the eccentric pivot pin 74 is shown more clearly in the cross-sectional view of FIG. 2B. The pivot pin 74 is housed in a large circular hole 82 and a small hole 84 in the two walls of handle 70; the eccentric segment 86 is located in a medium hole in blade 66. The pivot pin is axially secured by shoulder head 27 and C-clip 88.

FIG. 2C shows in more detail the front view of the pivot pin 74 with eccentric segment 86, rounded corner adjusting head 76, pointer and numeral markers. FIG. 2D shows an alternative hexagonal pin 94, which has many of the same features as the eccentric pivot pin 74, but provides more adjustment positions. In this design, the set screw 78 is replaced by an Allen screw 92 to provide a higher locking force.

Figure 3A:
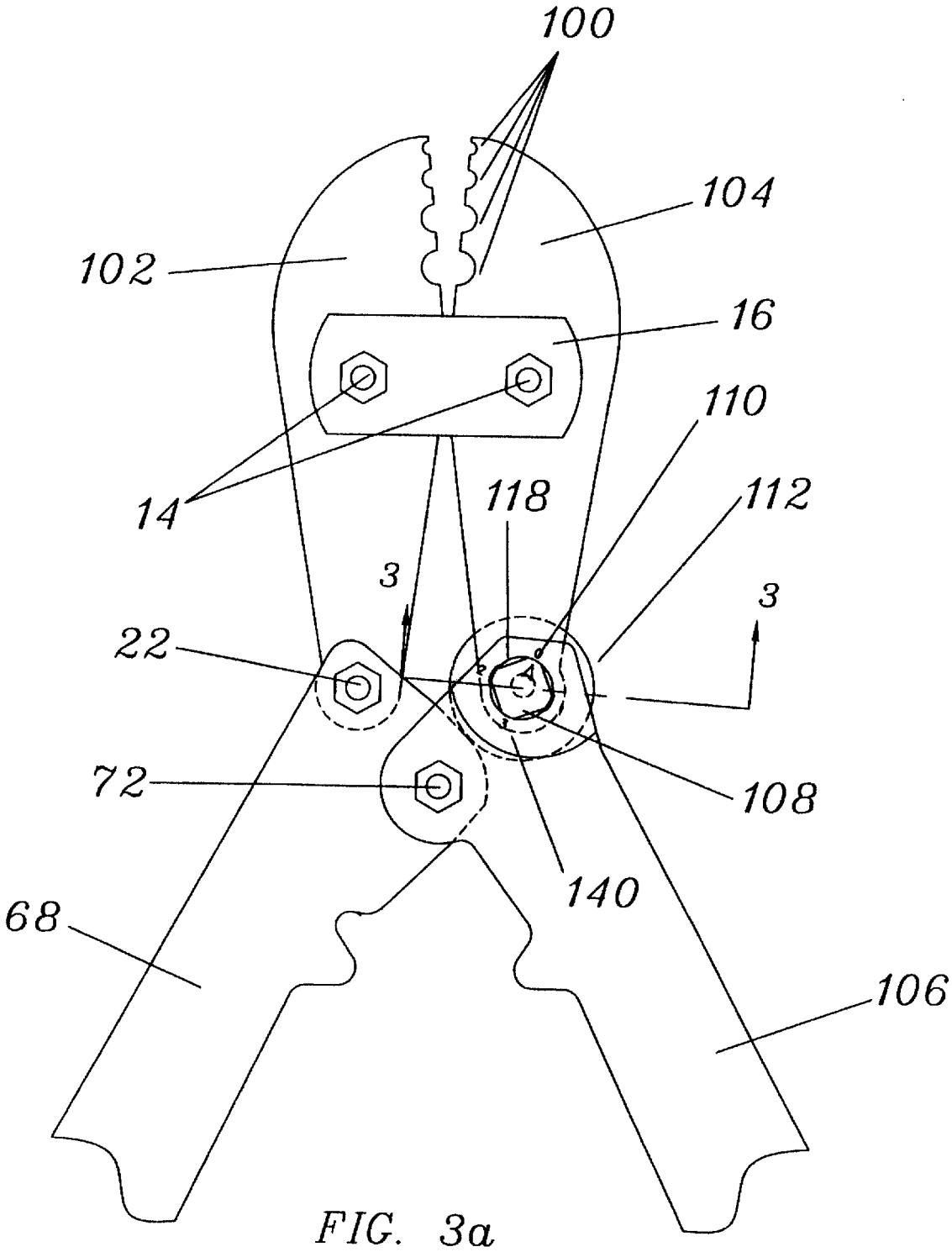
FIG. 3*a* shows a top view of an adjustment mechanism for hand tools in accordance with the third embodiment of the invention (as part of a swager tool).

A third embodiment of the adjustment mechanism incorporates a knob for the rotational adjustment rather than requiring an Allen wrench. This embodiment is shown in FIG. 3A, incorporated into a swaging tool. A cross-section of the adjustment mechanism is shown in FIG. 3B, following the section lines 3—3 in FIG. 3A. A cross-section of the eccentric pivot bolt is shown in FIG. 3C, following the section lines 4—4 in FIG. 3B. An alternative bolt design is presented in a similar cross-section in FIG. 3D.

The swaging tool in FIG. 3A has several sizes of compression holes 100 on blades 102 and 104, which are held together by plates 16 and blade bolts 14. Blade 102 is connected to handle 68 by handle bolt 22. The two handles 68 and 106 are connected by a central bolt 72. Blade 104 is connected to handle 106 by eccentric pivot bolt 108. The positioning of the eccentric pivot bolt is facilitated by a pointer 136 and numeral markers, such as the marker for a minimum at the numeral 0, shown as 138, and a maximum at the numeral 3, shown as 140.

The mechanism of the eccentric pivot bolt 108 is seen more clearly in cross-sectional view of FIG. 3B. The eccentric control bolt 108 is housed in a large quasi-circular hole 118 and a small hole 116 in the two walls of handle 106. The eccentric segment 130 is located in a medium hole 132 in blade 104. The eccentric pivot bolt 108 is axially secured on one side by a shoulder head 120. The bolt is secured on the other side by a friction washer 122 and an adjusting knob 112 screwed onto a threaded segment 126 of eccentric bolt 108. Controlled torque applied to knob 112 is done through a rounded corner square head 110.

FIG. 3C is a cross-section of the eccentric bolt in which the details of a rounded corner square head 110 and its locking capability into a quasi-circular hole 118 can be seen. The hole 118 has two matching rounded pockets 134 for clearance which prevent the eccentric bolt 108 from rotating under radial load. Under conditions of no load or low load the friction washer 122 prevents rotation of bolt 108. This double friction system allows easy positioning of the eccentric segment 130 via knob 112, while preventing rotation during high load operation.

Since the rounded corner square head 110 of bolt 108 is a few thousandths of an inch smaller than the minimum diameter of the large quasi-circular hole 118, rotational motion is allowed. However, the increased diameter at the rounded pockets 134, although very small, acts like a meshing gear under load and thus prevents rotation during operation. It should be noted that the rotational torque received by bolt 108 during operation is usually about equal between the large and small holes of handle 106 and the medium hole 132 of blade 104. The intrinsic self-power loading characteristic of the eccentric bolt through its rounded square section makes it capable of holding even high torque.

FIG. 3D shows an alternative design of the eccentric pivot bolt in which the contacting surfaces are a rounded hexagonal pivot bolt 144, with four rounded pockets 146, and the large quasi-circular hole 142.

The order of assembly of the second and third embodiments is similar to that of the first embodiment.

From the description above, a few of the advantages of my invention of an adjustment mechanism for hand tools become evident. In the operation of a hand tool such as a compression tool, bolt cutter, swaging tool and the like, it is frequently necessary for the user to make adjustments to the tool closure to reduce the size of the stroke either for wear compensation or stroke control; or to reduce the size of the tool so that two power strokes will achieve the intended result. My invention offers a low cost, compact, convenient, effective and reliable control adjustment for hand tools for many commercial and industrial uses.

OPERATION

The adjustment mechanism is utilized when it is desired to adjust the size of the stroke. In the preferred embodiment of the present invention, as shown in FIG. 1A, a square eccentric pivot pin 24, located at a pivot point of two handles 18 and 20, allows the user of the hand tool to vary the maximum distance that blade bolts 14 will move apart during full closure of the handles. This distance will determine how far the compression surfaces 12 of the blades 10 will close. As best seen in FIG. 1C, as it would appear removed from the mechanism, the eccentric pivot pin has four positions; a position is selected by the user using an Allen key in the Allen surface 38 to rotate the eccentric pivot pin. The pointer 48 is rotated to a higher numeral marker, up to the maximum numeral 3, shown as 50, to increase the total compression; or to a lower numeral marker, down to the minimum numeral 0, shown as 46, to reduce the total compression. The pressure pin 28, pushed against the square head flat surface 44 by a spring 30 compressed by an adjusting screw 32, maintains the position of the eccentric pivot pin during normal use of the tool, but does allow rotation of the pivot pin under a sufficient torque.

The hexagonal eccentric pivot pin shown in FIG. 1D differs in having five rotational adjustment positions rather than three. Also, the adjusting screw 54 that determines the pressure of the pin on the hexagonal head flat surface 52 is now an Allen screw.

In the alternative design shown in FIG. 1E, an adjusting knob 57 is used to select a position of the pivot pin. The knob allows the user to adjust the stroke more quickly and easily without the need for an Allen wrench. A stopper 60 limits the rotation of the knob 57.

A second embodiment of the present invention, shown in FIG. 2, has an eccentric pivot pin 74 that is locked directly by a set screw 78. Adjustment of the pivot pin is achieved by loosening the set screw 78, rotating the rounded corner adjusting head 76, and relocking screw 78. This procedure provides a direct locking of the adjustment mechanism suited to heavy-duty applications where frequent adjustment is not necessary.

In a third embodiment of the present invention, shown in FIGS. 3, the position of the eccentric pivot bolt 108 is adjusted by means of a knob 112, and marked by a pointer 136 and numerals from a minimum of 0, shown as 138, to a maximum of 3, shown as 140. The position is held with precision by a combination of a friction washer 122 and shoulder head 120. Initial tightening of the knob 112 is accomplished by holding the rounded corner square head 110 with an open wrench while rotating knob 112.

CONCLUSIONS AND RAMIFICATIONS

The adjustable mechanism for hand tools presented here offers many advantages over current mechanisms. The adjustable eccentric pin is both easily adjusted and easily manufactured. The eccentric pin is also capable of withstanding the high loads associated with heavy duty hand tools such as bolt cutters, swaggers, and crimping tools.

It should be noted that the present invention should not be restricted to any particular arrangement or any specific embodiment disclosed herein. The present invention should also not be limited to any specific tool. The adjustable mechanism presented here could be used on equipment ranging from bolt cutters and swaging tools to table production tools. The high load carrying capacity of the presented mechanism allows the mechanism to be used on any tool.

Many of the components in this invention can be altered while still performing the same function. For example, the spring and adjusting screw retaining the eccentric pin could be replaced with a single screw constructed out of a resilient material such as nylon. A nylon screw with a steel head could be alternately used. Another means of preventing the rotation of the eccentric pivot pin could be the use of a spring loaded wire abutting against the side of the eccentric pin head.

The adjusting knob on the eccentric pin could be located at either the front of rear of the tool. Also, several of the shapes of matching components could be changed and still operate in a similar fashion. Thus the scope of the invention should be determined by the appended claims and their legal equivalents rather than by the examples given.

What is claimed is:

1. An adjustable mechanism for tools having at least one moveable blade or jaw including a load transferring means securing the moveable members together, at least one moveable handle to transfer power to the tool, said adjustable mechanism comprising:

a) an eccentric pivot pin having an eccentric circular cross section in the middle of said eccentric pivot pin and having an inline circular cross section at one end, said eccentric pivot pin having an enlarged head with a plurality of circumferentially extending detents formed thereon at an opposed end, said eccentric circular cross section contacting a first load transferring member, said inline circular cross section contacting a second load transferring member, b) a locking means securing said eccentric pivot pin from moving axially, c) a pressure means comprising a longitudinally extending member mounted radially with respect to a longitudinal axis of said pivot pin and being designed to exert a force on one of said detents on said pivot pin head whereby said eccentric pivot pin is prevented from rotating during normal operation of said tool, d) a control means on one end of said eccentric pivot pin whereby rotation of said control means rotates said eccentric pivot pin.

2. The adjustable mechanism of claim 1 wherein said eccentric pivot pin head is of polygonal shape with rounded corners.

3. The adjustable mechanism of claim 2 wherein said power transfer member contains markings showing the successive positions of said eccentric pivot pin whereby the position of said blade or jaw can be adjusted from one extreme to another.

4. The adjustable mechanism of claim 3 wherein said locking means is a spring clip or locking pin.

5. The adjustable mechanism of claim 3 wherein said control means contains a hexagonal hole for adjustment with a hex wrench.

6. The adjustable mechanism of claim 3 wherein said control means contains a hexagonal head for adjustment with a wrench.

7. The adjustable mechanism of claim 3 wherein said control means contains a control lever to allow hand adjustment.

8. The adjustable mechanism of claim 3 wherein said control means contains a handwheel to allow hand adjustment.

9. The adjustable mechanism of claim 3 wherein said pressure means is an elastic member which flexes during adjustment of said eccentric pivot pin but provides adequate pressure to prevent rotation of said eccentric pivot pin during normal use of said tool.

10. The adjustable mechanism of claim 3 wherein said pressure means is an adjustable spring loaded pin.

11. The adjustable mechanism of claim 3 wherein said pressure means is a locking screw.

12. The adjustable mechanism of claim 3 wherein said eccentric pivot pin is located at the pivot between said blade or jaw and said load transferring member.

13. The adjustable mechanism of claim 3 wherein said eccentric pivot pin is located at the pivot between said handle and said blade or jaw.

14. The adjustable mechanism of claim 3 wherein said eccentric pivot pin is located at the pivot between said handle and a second handle.

15. The adjustable mechanism of claim 3 wherein said eccentric pivot pin is located at a pivot connecting a table-mounted member of said tool to a member of said tool which moves relative to said table-mounted member.

16. The adjustable mechanism of claim 3 wherein a second eccentric pivot pin is located at a second pivot point, whereby additional adjustment of said blade or jaw is possible.

17. A hand tool having first and second handles with said first handle being moveable and having at least one moveable blade or jaw including a load transferring means securing the moveable members together, and an adjustable mechanism connecting said handles, said adjustable mechanism comprising:

a) an eccentric pivot pin having an eccentric circular cross section in the middle of said eccentric pivot pin and having an inline circular cross section at one end, said eccentric pivot pin having an enlarged head with a plurality of detents thereon at the other end, said eccentric circular cross section contacting a first load transferring member, said inline circular cross section contacting a second load transferring member, b) a locking means securing said eccentric pivot pin from moving axially, c) a pressure means pressing against one of said detents whereby said eccentric pivot pin is prevented from rotating during normal operation of said tool, d) a control means on one end of said eccentric pivot pin whereby rotation of said control means rotates said eccentric pivot pin.

18. The hand tool having first and second handles and first and second jaws, at least one of said handles and jaws being pivotably connected, each of said pivotably connected jaw and pivotably connected handle having an adjustable mechanism, said adjustable mechanism comprising:

a) an eccentric pivot pin having an eccentric circular cross section in the middle of said eccentric pivot pin and having an inline circular cross section at one end, said eccentric pivot pin having an enlarged head with a plurality of detents thereon at the other end, said eccentric circular cross section contacting a first load transferring member, said inline circular cross section contacting a second load transferring member, b) a locking means securing said eccentric pivot pin from moving axially, c) a pressure means pressing against one of said detents whereby said eccentric pivot pin is prevented from rotating during normal operation of said tool, d) a control means on one end of said eccentric pivot pin whereby rotation of said control means rotates said eccentric pivot pin.

19. An adjustable mechanism for tools having at least one moveable blade or jaw including a load transferring means securing the moveable members together, at least one moveable handle to transfer power to the tool, said adjustable mechanism comprising:

a) an eccentric pivot pin having an eccentric circular cross section in the middle of said eccentric pivot pin and having an in-line circular cross section at one end, said eccentric pivot pin having a polygonal head at an opposed end, said polygonal head having a plurality of flat surfaces formed thereon, said eccentric circular cross section contacting a first load transferring member, said in-line circular cross section transferring a second load transferring member, b) a locking means securing said eccentric pivot pin from moving axially, c) a pressure means comprising a spring member exerting a force on one of said flat surfaces of said polygonal head whereby said eccentric pivot pin is prevented from rotating during normal operation of said tool, and d) a control means on one end of said eccentric pivot pin whereby rotation of said control means rotates said eccentric pivot pin, the force exerted on one of said faces of said polygonal head being sufficiently low to permit rotation of said eccentric pivot pin by rotation of said control means.

* * * * *